US009845797B2

(12) United States Patent
Ki et al.

(10) Patent No.: US 9,845,797 B2
(45) Date of Patent: Dec. 19, 2017

(54) RECIPROCATING COMPRESSOR AND METHOD FOR DRIVING SAME

(71) Applicant: LG ELECTRONICS INC., Seoul (KR)

(72) Inventors: Sunghyun Ki, Seoul (KR); Kiwon Noh, Seoul (KR); Kwangwoon Ahn, Seoul (KR); Kyeongbae Park, Seoul (KR); Simoon Jeon, Seoul (KR); Joonsung Park, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 225 days.

(21) Appl. No.: 14/424,061

(22) PCT Filed: Aug. 30, 2013

(86) PCT No.: PCT/KR2013/007814

§ 371 (c)(1),
(2) Date: Feb. 26, 2015

(87) PCT Pub. No.: WO2014/035181

PCT Pub. Date: Mar. 6, 2014

(65) Prior Publication Data

US 2015/0226191 A1 Aug. 13, 2015

(30) Foreign Application Priority Data

Sep. 3, 2012 (KR) ..... 10-2012-0097276
Sep. 3, 2012 (KR) ..... 10-2012-0097278

(51) Int. Cl.
*F04B 35/04* (2006.01)
*F04B 49/20* (2006.01)
(Continued)

(52) U.S. Cl.
CPC ..... *F04B 35/045* (2013.01); *F04B 35/04* (2013.01); *F04B 39/0292* (2013.01);
(Continued)

(58) Field of Classification Search
CPC ..... F04B 35/04; F04B 35/045; F04B 53/008; F04B 49/20; F04B 39/0296;
(Continued)

(56) References Cited

U.S. PATENT DOCUMENTS 7,816,873 B2 * 10/2010 Choi ..... F04B 35/045 318/119
2005/0008512 A1 1/2005 McGill et al.
(Continued)

FOREIGN PATENT DOCUMENTS

CN 2423492 Y 3/2001
CN 1458413 A 11/2003
(Continued)

OTHER PUBLICATIONS

Chinese Office Action dated Aug. 2, 2016 (Translation).
(Continued)

*Primary Examiner* — Alexander Comley
(74) *Attorney, Agent, or Firm* — KED & Associates, LLP

(57) ABSTRACT

The present disclosure relates to reciprocating compressor. The present invention can prevent friction loss or abrasion between a cylinder and a piston, which is caused when a hydraulic bearing is blocked with a foreign substance, by preventing the foreign substance mixed in refrigerant gas from flowing into the hydraulic bearing, and can improve compressor performance by preventing a specific volume in a compression space from increasing when high-temperature refrigerant gas discharged in the compression space is cooled, such that vibration noise of the compressor can be reduced since a gas guiding part offsets vibration and the
(Continued)

noise generated when a refrigerant is discharged in the compression space. Furthermore, the number of vibrations of a mover is increased and a driving operation for removing foreign substances is carried out to increase the number of vibrations of a cylinder such that any foreign substance stuck in a gas hole can be cleaned, thereby increasing performance and reliability of the compressor.

10 Claims, 11 Drawing Sheets

(51) Int. Cl.

| | |
|---|---|
| ***F04B 49/06*** | (2006.01) |
| ***F04B 53/20*** | (2006.01) |
| ***F04B 53/00*** | (2006.01) |
| ***F04B 39/02*** | (2006.01) |
| ***F04B 39/16*** | (2006.01) |
| *F04B 17/03* | (2006.01) |

(52) U.S. Cl.
CPC ..... *F04B 39/16* (2013.01); *F04B 49/065* (2013.01); *F04B 49/20* (2013.01); *F04B 53/004* (2013.01); *F04B 53/20* (2013.01); *F04B 17/03* (2013.01)

(58) Field of Classification Search
CPC .... F04B 39/0276; F04B 53/004; F04B 53/20; F04B 39/16; F04B 49/06–49/065
USPC ..... 384/12, 624; 417/417, 418
See application file for complete search history.

(56) References Cited

U.S. PATENT DOCUMENTS

| | | | | |
|---|---|---|---|---|
| 2008/0000348 | A1 | 1/2008 | Schubert et al. | |
| 2008/0008606 | A1 | 1/2008 | Muth et al. | |
| 2009/0238701 | A1* | 9/2009 | Giacchi ..... | F04B 39/16 417/321 |

FOREIGN PATENT DOCUMENTS

| | | | |
|---|---|---|---|
| CN | 101512154 | A | 8/2009 |
| CN | 201446080 | U | 5/2010 |
| CN | 202064204 | U | 12/2011 |
| CN | 202117880 | | 1/2012 |
| EP | 0156462 | A2 | 10/1985 |
| JP | 2005-264744 | A | 9/2005 |
| JP | 2006-189038 | A | 7/2006 |
| KR | 10-2007-0075909 | A | 7/2007 |
| KR | 10-2007-0098813 | A | 10/2007 |

OTHER PUBLICATIONS

European Search Report dated Jun. 1, 2016 issued in Application No. 13833495.8.
International Search Report and Written Opinion dated Dec. 6, 2013 issued in Application No. PCT/KR2013/007814.
Chinese Office Action dated Feb. 26, 2016 issued in Application No. 201380045924.7.

* cited by examiner

RECIPROCATING COMPRESSOR AND METHOD FOR DRIVING SAME

CROSS-REFERENCE TO RELATED PATENT APPLICATIONS

This application is a U.S National Stage Application under 35 U.S.C. §371 of PCT Application No. PCT/KR2013/007814, filed Aug. 30, 2013, which claims priority to Korean Patent Application Nos. 10-2012-0097276 and 10-2012-0097278, both filed Sep. 3, 2012, whose entire disclosures are hereby incorporated by reference.

TECHNICAL FIELD

The present disclosure relates to a reciprocating compressor, and more particularly, a reciprocating compressor having a fluid bearing, and a method for driving the same.

BACKGROUND ART

Generally, a reciprocating compressor serves to intake, compress, and discharge a refrigerant as a piston linearly reciprocates within a cylinder. The reciprocating compressor may be classified into a connection type reciprocating compressor or a vibration type reciprocating compressor according to the method employed to drive the piston.

In the connection type reciprocating compressor, the piston is connected to a rotating shaft associated with a rotation motor by a connection rod, which causes the piston to reciprocate within the cylinder, thereby compressing the refrigerant. On the other hand, in the vibration type reciprocating compressor, the piston is connected to a mover associated with a reciprocating motor, which vibrates the piston while the piston reciprocates within the cylinder, thereby compressing the refrigerant. The present invention relates to the vibration type reciprocating compressor, and the term "reciprocating compressor" will hereinafter refer to the vibration type reciprocating compressor.

To enhance the performance of a reciprocating compressor, a portion between the cylinder and the piston, being hermetically sealed, has to be properly lubricated. To this end, there has been conventionally known a reciprocating compressor which seals and lubricates the portion between the cylinder and the piston by supplying a lubricant such as oil between the cylinder and the piston and forming an oil film. However, the supplying of the lubricant requires an oil supply apparatus, and an oil shortage may occur depending on operation conditions, thereby degrading compressor performance. Also, the compressor size needs to be increased because a space for receiving a certain amount of oil is required, and the installation direction of the compressor is limited because the entrance of the oil supply apparatus should always be kept immersed in oil.

Taking into consideration the disadvantages of the oil-lubricated type reciprocating compressor, as illustrated in FIGS. 1 and 2, there has been conventionally known a technique of forming a fluid bearing between a piston 1 and a cylinder 2 by bypassing a part of compressed gas between the piston 1 and the cylinder 2. A plurality of gas holes 2*a* each having a small diameter are formed through the cylinder 2 to inject the compression gas into an inner circumferential surface of the cylinder 2.

This technique can simplify a lubrication structure of the compressor because it requires no oil supply apparatus, unlike the oil-lubricated type for supplying oil between the piston 1 and the cylinder 2, and can maintain constant compressor performance by preventing an oil shortage depending on operating conditions. Also, this technique has the advantage that the compressor can be smaller in size and the installation direction of the compressor can be freely designed because no space for receiving oil is required in the casing of the compressor. Unexplained reference number 3 denotes a plate spring (a leaf spring), 5*a* to 5*c* denote connecting bars, and 6*a* and 6*b* denote links.

However, in the related art reciprocating compressor, foreign substances mixed with refrigerant gas are introduced into the a fluid bearing to block the fluid bearing, thereby preventing the refrigerant gas from being supplied between the cylinder 2 and the piston 1. Accordingly, concentricity between the piston 1 and the cylinder 2 is destroyed, thereby causing a friction loss and abrasion while the piston 1 reciprocates with being closely adhered to the cylinder 2.

Also, as high-temperature refrigerant gas discharged from a compression space is introduced into the fluid bearing to heat the cylinder 2, a specific volume of a compression space increases and thereby a suction loss is caused.

Furthermore, discharge noise and vibration which are generated while a refrigerant compressed in the compression space is discharged cannot effectively be offset, thereby increasing vibration noise of the compressor.

DISCLOSURE OF THE INVENTION

Therefore, to obviate those problems, an aspect of the detailed description is to provide a reciprocating compressor, capable of preventing a friction loss and abrasion between a cylinder and a piston, which are caused when a fluid bearing is blocked by foreign materials (or substances) mixed with refrigerant gas, in a manner of blocking the foreign materials from being introduced into the fluid bearing, and a method for driving the same.

Another aspect of the present invention is to provide a reciprocating compressor, capable of preventing in advance suction loss, caused due to an increased specific volume of a compression space, in a manner of preventing a cylinder from being heated by high-temperature refrigerant gas discharged from a compression space, and a method for driving the same.

Another aspect of the present invention is to provide a reciprocating compressor, capable of reducing vibration noise of the compressor by effectively offsetting vibration and noise which are generated as a refrigerant is discharged from a compression space, and a method for driving the same.

To achieve these and other advantages and in accordance with the purpose of the present invention, as embodied and broadly described herein, there is provided a reciprocating compressor including a casing having an inner space communicating with a suction pipe, a frame provided in the inner space of the casing, a reciprocating motor coupled to the frame, and having a mover, the mover performing a linear reciprocating motion, a cylinder coupled to the frame and having a compression space, a piston inserted into the cylinder to perform a reciprocating motion, the piston having a suction passage formed therethrough in a lengthwise direction to guide a refrigerant into the compression space, a discharge cover installed at an end side of the cylinder and having a discharge space communicating with a discharge pipe, a fluid bearing having gas holes formed through the cylinder and configured to inject fluid therethrough into a portion between the cylinder and the piston so as to support the piston with respect to the cylinder, and a block-preventing unit configured to prevent the gas holes of the fluid bearing from being blocked due to foreign materials.

The reciprocating compressor may further include a discharge cover provided at an end side of the cylinder and having the discharge space to communicate with the discharge pipe. The discharge space and inlets of the gas holes may communicate with each other through a gas guiding pipe. The gas guiding pipe may be partially exposed to the outside of the discharge cover, and a filtering unit may be installed at the exposed gas guiding pipe to filter off the foreign materials.

Also, the reciprocating compressor may further include a vibration unit configured to vibrate the cylinder.

To achieve these and other advantages and in accordance with the purpose of the present invention, as embodied and broadly described herein, there is provided a method for driving a reciprocating compressor, the method including determining whether or not a foreign material-removing operation is required, shaking out foreign materials from gas holes of a cylinder by increasing the number of vibrations of a piston when the foreign material-removing operation is required, and executing a normal operation by decreasing the number of vibrations of the piston.

Advantageous Effect

In a reciprocating compressor and a method for driving the same according to the present invention, a friction loss and abrasion, which are caused between a cylinder and a piston because the piston is closely adhered on the cylinder due to gas holes of a fluid bearing being blocked by foreign materials mixed with refrigerant gas, can be prevented by preventing the foreign materials from being introduced into the fluid bearing.

Also, as a gas guiding pipe is provided in an inner space of a casing, separate from a discharge cover, high-temperature refrigerant gas discharged from a compression space can be cooled by performing heat exchange with a sucked refrigerant filled in the inner space of the casing, and accordingly a cylinder forming a gas pocket can be cooled. This may result in reducing a specific volume of the compression space and thus improving compressor performance.

Also, vibration and noise which are generated as a refrigerant is discharged from a compression chamber can be offset by a guide guiding unit, thereby reducing vibration noise of the compressor.

In addition, even though gas holes are blocked due to foreign materials being introduced into a fluid bearing along with a refrigerant, a cylinder may vibrate by temporarily increasing the number of vibrations of a mover, so as to remove the foreign materials stuck in the gas holes. This may result in preventing a friction loss and abrasion, which are caused between the cylinder and a piston because the piston is closely adhered on the cylinder due to the gas holes of the fluid bearing being blocked by the foreign materials.

MODES FOR CARRYING OUT THE PREFERRED EMBODIMENTS

Hereinafter, description will be given in detail of a reciprocating compressor according to one embodiment illustrated in the accompanying drawings.

Figure 1:
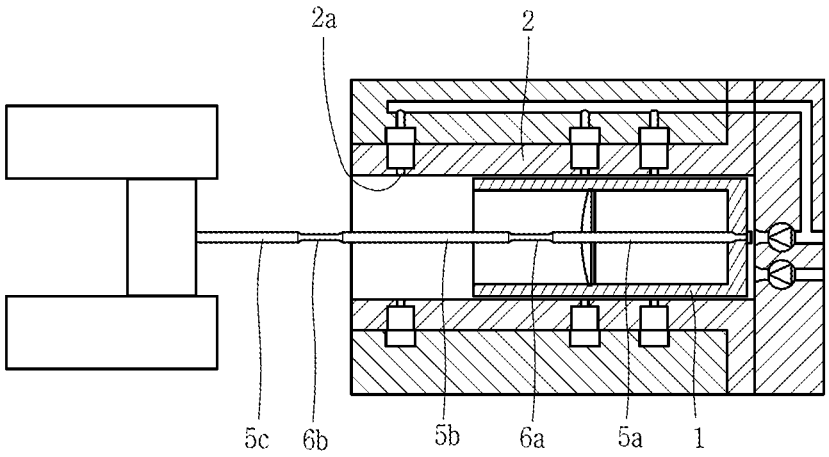
FIG. 1 is a longitudinal sectional view illustrating an example that a gas bearing is applied to a reciprocating compressor according to the related art.
Figure 2:
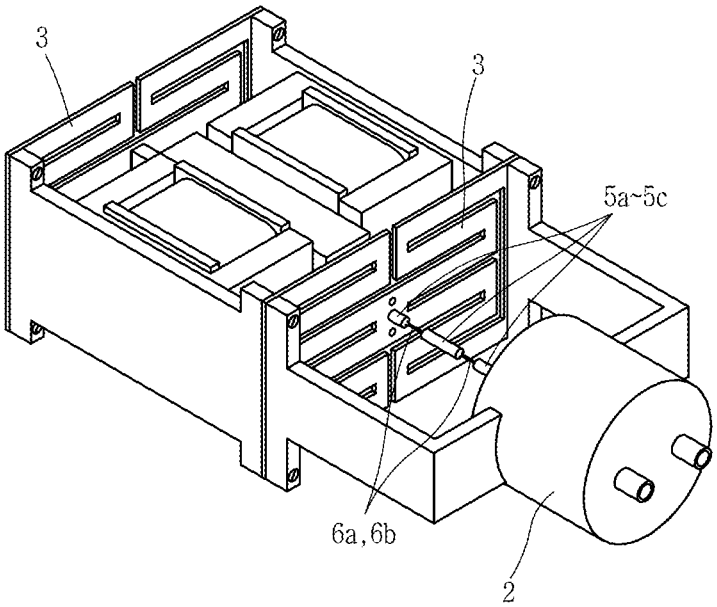
FIG. 2 is a perspective view illustrating an example that a leaf spring is applied to a reciprocating compressor according to the related art.
Figure 3:
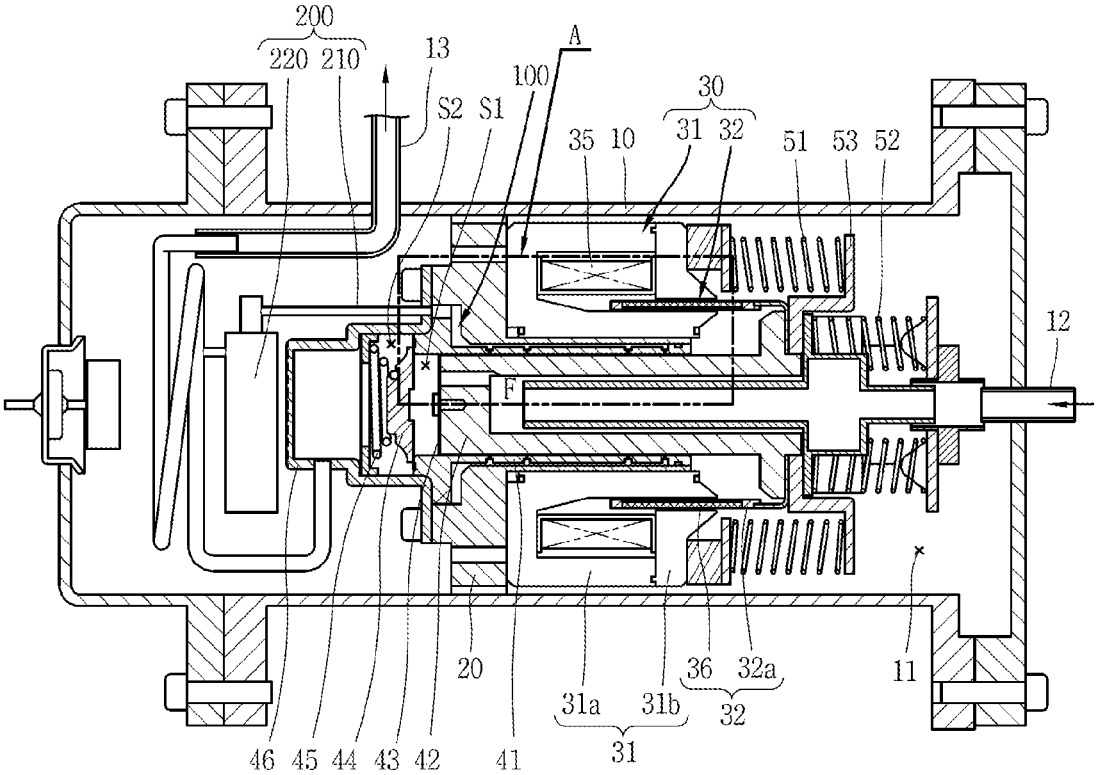
FIG. 3 is a longitudinal sectional view of a reciprocating compressor in accordance with the present invention.

FIG. 3 is a longitudinal sectional view of a reciprocating compressor in accordance with the present invention.

As illustrated in FIG. 3, in a reciprocating compressor according to an embodiment disclosed herein, a suction pipe 12 may be connected to an inner space 11 of a casing 10, and a discharge pipe 13 may be connected to a discharge space S2 of a discharge cover 46 to be explained later. A frame 20 may be disposed in the inner space 11 of the casing 10. A stator 31 of a reciprocating motor 30 and a cylinder 41 may be fixed to the frame 20. A piston 42 which is coupled to a mover 32 of the reciprocating motor 30 may be inserted into the cylinder 41 so as to reciprocate therein. Resonant springs 51 and 52 for inducing a resonating motion of the piston 42 may be provided at both sides of the piston 42 in a motion direction of the piston 42.

A compression space S1 may be defined in the cylinder 41, and a suction passage F may be formed in the piston 42. A suction valve 43 for opening and closing the suction passage F may be provided at an end of the suction passage F. A discharge valve 44 for opening and closing the compression space S1 of the cylinder 41 may be provided at an end surface of the cylinder 41.

In the reciprocating compressor having such configuration, when power is applied to the reciprocating motor 30, the mover 32 of the reciprocating motor 30 reciprocates with respect to a stator 31. The piston 42 coupled to the mover 32 then linearly reciprocates within the cylinder 41. Accordingly, a refrigerant can be sucked, compressed and discharged.

Explaining the process in detail, when the piston 42 is moved backwards, a refrigerant of the casing 10 is introduced into the compression space S1 through the suction passage F of the piston 42. When the piston 42 is moved forwards, the suction passage F is closed such that the refrigerant can be compressed in the compression space S1. When the piston 42 is further moved forwards, the refrigerant compressed in the compression chamber S1 is discharged as the discharge valve 44 is open, so as to flow toward a refrigerating cycle.

Here, a coil 35 may be inserted into the stator 31 of the reciprocating motor 30 to be coupled thereto, and an air gap may be formed only at one side of the coil 35. The mover 32 may be provided with magnets 36 each of which is inserted into the air gap of the stator 31 so as to reciprocate in a motion direction of the piston 42.

The stator 31 may include a plurality of stator blocks 31*a*, and a plurality of pole blocks 31*b* coupled to sides of the stator blocks 31*a*, respectively, to form air gap portions 31*c* along with the stator blocks 31*a*.

The stator blocks 31*a* and the pole blocks 31*b* may be configured in a manner of laminating a plurality of thin stator cores sheet by sheet into an arcuate shape when axially projected. The stator blocks 31*a* may be formed in the shape of recesses (⊏) when axially projected, and the pole blocks 31*b* may be formed in a rectangular shape (|) when axially projected.

The mover 32 may include a magnet holder 32*a* formed in a cylindrical shape, and a plurality of magnets 36 coupled to an outer circumferential surface of the magnet holder 32*a* in a circumferential direction so as to form a magnetic flux along with the coil 35.

The magnet holder 32*a* may preferably be formed of a non-magnetic substance to prevent a leakage of magnetic flux, but may not be limited thereto. The outer circumferential surface of the magnetic holder 32*a* may be formed in a circular shape so that the magnets 36 are in line contact therewith and adhered thereto. A magnet mounting groove (not illustrated) may be formed in a strip shape on the outer circumferential surface of the magnet holder 32*a* so as to insert the magnets 36 therein and support them in the motion direction.

The magnets 36 may be formed in a hexahedral shape and adhered one by one to the outer circumferential surface of the magnet holder 32*a*. In the case of attaching the magnets 36 one by one, supporting members (not shown), such as fixing rings or a tape made up of a composite material, may be fixed to outer circumferential surfaces of the magnets 36 in a covering manner.

Although the magnets 36 may be serially adhered in a circumferential direction to the outer circumferential surface of the magnet holder 32*a*, it is preferable that the magnets 36 are adhered at predetermined intervals, i.e., between the stator blocks in a circumferential direction to the outer circumferential surface of the magnet holder 32*a* to minimize the use of the magnets, because the stator 31 comprises the plurality of stator blocks 31*a* and the plurality of stator blocks 31*b* are arranged at predetermined intervals in the circumferential direction.

Preferably, the magnet 36 may be configured such that its length in a motion direction is not shorter than a length of the air gap portion 31*c* in the motion direction, more particularly, longer than the length of the air gap portion 31*c* in the motion direction. At its initial position or during its operation, the magnet 36 may be disposed such that at least one end thereof is located inside the air gap portion 31*c*, in order to ensure a stable reciprocating motion.

Moreover, though only one magnet 36 may be disposed in the motion direction, a plurality of magnets 36 may be disposed in the motion direction in some cases. In addition, the magnets may be disposed in the motion direction so that an N pole and an S pole correspond to each other.

Although the above-described reciprocating motor may be configured such that the stator has one air gap portion 31*c*, it may be configured such that in some cases the stator has air gap portions 31*c* on both sides of the coil in the lengthwise direction. In this case, the mover may be formed in the same manner as the foregoing embodiment.

In the above-stated reciprocating compressor, it is required to reduce a frictional loss between the cylinder 41 and the piston 42 to improve the performance of the compressor. To this end, there has been conventionally known a fluid bearing which lubricates between the cylinder 41 and the piston 42 by gas force by bypassing a part of compressed gas between an inner circumferential surface of the cylinder 41 and an outer circumferential surface of the piston 42.

Figure 4:
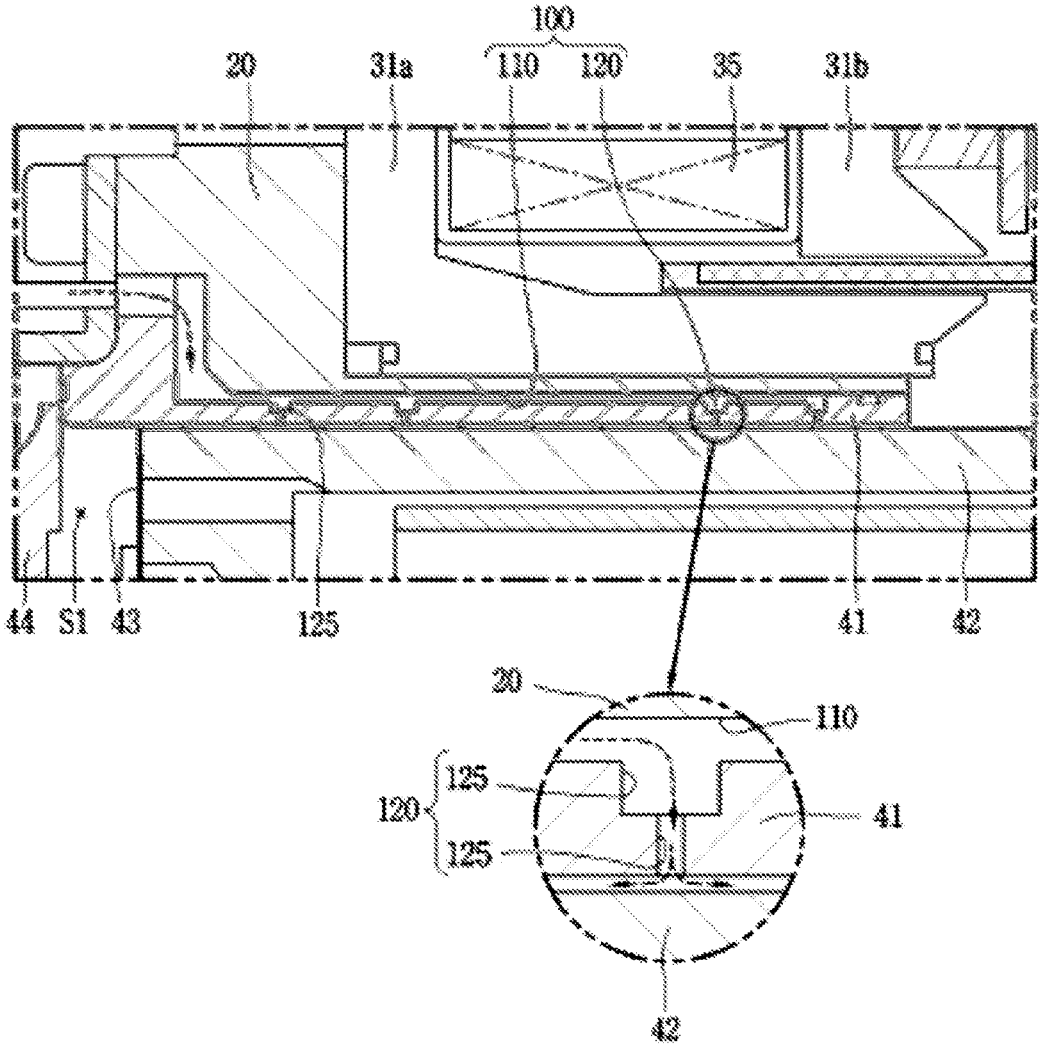
FIG. 4 is an enlarged view of a part "A" of FIG. 3, namely, a sectional view illustrating one embodiment of a fluid bearing.

FIG. 4 is an enlarged view of a part "A" of FIG. 3, namely, a sectional view illustrating one embodiment of a fluid bearing.

As illustrated in FIGS. 3 and 4, a fluid bearing (or a hydraulic bearing) 100 may include a gas pocket 110 formed on an inner circumferential surface of the frame 20 by a predetermined depth, and a plurality of columns of gas holes 120 communicating with the gas pocket 110 and penetrating through the inner circumferential surface of the cylinder 41. Here, the column of gas holes refers to gas holes which are formed on the same circumference at positions corresponding to the same length along a lengthwise direction of the cylinder.

The gas pocket 110 may be formed in an annular shape along the entire inner circumferential surface of the frame 20, but in some cases, may be provided in plural arranged with predetermined intervals along the circumferential direction of the frame 20.

A gas guiding unit 200 may be coupled to an inlet of the gas pocket 110 to guide some of the compression gas, which has been discharged from the compression space into the discharge space S2, from the discharge space S2 to the fluid bearing 100.

Here, the gas pocket 110 may be located between the frame 20 and the cylinder 41. Alternatively, the gas pocket 110 may be provided at an end surface of the cylinder 41 along the lengthwise direction of the cylinder 41. In this instance, since the gas pocket 110 is formed to communicate directly with the discharge space S2 of the discharge cover 46, a separate gas guiding unit may not be needed. This may simplify an assembly process and reduce fabricating costs.

Referring to FIG. 3, the resonant springs may include a first resonant spring 51 and a second resonant spring 52, both of which are provided at both sides in a back-and-forth direction of a spring supporter 53, which is coupled to the mover 32 and the piston 42.

The first resonant spring 51 and the second resonant spring 52 each are provided in plural and arranged along a circumferential direction. However, either the first resonant spring 51 or the second resonant spring 52 may be provided in plural and the other may be provided in singular.

The first resonant spring 51 and the second resonant spring 52, as aforementioned, may be implemented as a compression coil spring. Accordingly, when the resonant springs 51 and 52 are expanded, side force may be produced. Therefore, the resonant springs 51 and 52 may be arranged to offset the side force or torsion moment of the resonant springs 51 and 52.

For example, in the case that the first resonant spring 51 and the second resonant spring 52 are arranged alternately by twos in a circumferential direction, distal ends of the first and second resonant springs 51 and 52 may be wound at the same position in opposite directions (counterclockwise) relative to the center of the piston 42, and the resonant springs on the same side positioned in their respective diagonal directions may be arranged to symmetrically engage each other so that a side force and a torsion moment are produced in opposite directions.

Also, the first resonant spring 51 and the second resonant spring 52 may be arranged to symmetrically engage the distal ends of the resonant springs with each other so that side force and torsion moment are produced in opposite directions along the circumferential direction.

Preferably, spring fixing protrusions 531 and 532 are respectively formed on a frame or spring supporter 53, to which the ends of the first and second resonant springs 51 and 52 are fixed, in order for the resonant springs 51 and 52 to be press-fitted into the spring fixing protrusions 531 and 532, because the engaged resonant springs are prevented from turning.

The number of first resonant springs 51 may be equal to or different from the number of second resonant springs 52 as long as the first resonant spring 51 and the second resonant spring 52 have the same elasticity.

When the resonant springs 51 and 52 configured as the compression coil spring are applied, side force may be produced while the compression coil spring is expanded and accordingly linearity of the piston 42 may be lost. However, as illustrated in this embodiment, when the first resonant spring 51 and the second resonant spring 52 each are provided in plural and arranged to be wound in opposite directions to each other, the side force and the torsion moment produced by each of the resonant springs 51 and 52 may be offset by the resonant springs, symmetrical in the diagonal direction, thereby maintaining the linearity of the piston 52 and preventing in advance abrasion of a surface of the piston 52 in contact with the resonant springs 51 and 52.

Also, since the resonant springs 51 and 52 are implemented as the compression coil spring which is not locked in a horizontal direction and exhibits less transformation in a vertical direction, the compressor can also be installed in a vertical manner as well as a horizontal manner. Also, with no need of separate connecting bars or links to connect the mover 32 and the piston 42 to each other, material costs and the number of assembling stages can be reduced.

Meanwhile, in this embodiment, although the weight of the piston increases because the piston is formed longer than the cylinder, since the resonant springs are configured as the compression coil spring, the piston is likely to be hung down in view of the characteristic of the compression coil spring. This may bring about a friction loss and abrasion between the piston and the cylinder. Specifically, when the piston is supported by supplying gas, not supplying oil, between the cylinder and the piston, gas holes should be appropriately arranged, in order to prevent the piston from being hung down and thus prevent the friction loss or the abrasion between the cylinder and the piston.

For example, gas holes 120 which penetrate through the inner circumferential surface of the cylinder 41 may be formed with predetermined intervals over an entire region of the piston 42 in a lengthwise direction of the piston 42. That is, when the length of the piston 42 is longer than that of the cylinder 41 and the piston 42 performs a reciprocating motion in a horizontal direction, the positions of the gas holes 120 for injecting gas therethrough into a portion between the cylinder 41 and the piston 42 may be uniformly formed even on a rear region of the piston 42 as well as front and central regions of the piston 42, adjacent to a compression space S1. In such a manner, the fluid bearing 100 can stably support the piston 42 and thus the friction loss and the abrasion between the cylinder 41 and the piston 42 can be prevented in advance.

Specifically, when the compression coil spring is employed as the resonant springs 51 and 52 for inducing the resonating motion of the piston 42, the piston 42 may be more hung down due to the great vertical transformation of the compression coil spring. However, since the gas holes 120 are evenly provided all over the regions (A), (B) and (C) along the lengthwise direction of the piston 42, the piston 42 may not be hung down and can smoothly perform the reciprocating motion, thereby effectively preventing the friction loss and the abrasion between the cylinder 41 and the piston 42.

In the meantime, in order to prevent drooping of the piston to avoid the friction loss and the abrasion between the cylinder and the piston, the reciprocating compressor according to this embodiment should be configured such that a total cross-section of the gas holes arranged at a lower portion of the cylinder is greater than a total cross-section of the gas holes arranged at an upper portion of the cylinder.

To this end, the gas holes 120 may be provided in a manner that the number of gas holes located at the lower portion is greater than the number of gas holes located at the upper portion of the cylinder 41 or the cross-section of the gas holes located at the lower portion is greater than the cross-section of the gas holes located at the upper portion. And, the gas holes may be configured such that the number or cross-section thereof increases from a top to a bottom of the cylinder 41, thereby increasing a supporting force for supporting a lower side of the fluid bearing.

A gas guiding groove 125 which guides compressed gas introduced into the gas pocket 110 into the gas holes 120 and simultaneously serves as a type of buffer may be formed at entrances of the gas holes 120, respectively. The gas guiding grove 125 may be formed in an annular shape such that the gas holes arranged in each column can communicate with one another, or be provided in plural and arranged with predetermined intervals along a circumferential direction such that the gas holes in each column can be independent of one another. However, it may be preferable that the plurality of gas guiding grooves 125 are provided to the gas holes 120, respectively, with predetermined intervals along the circumferential direction, so as to equalize compressed gas and compensate for strength of the cylinder.

Meanwhile, upon employing the fluid bearing as illustrated in this embodiment, when foreign substances mixed with a refrigerant are introduced into the fluid bearing, the foreign substances may block the fine gas holes so as to interfere with a smooth introduction of refrigerant gas between the cylinder and the piston. When the refrigerant gas is not supplied between the cylinder and the piston, the piston comes in contact with the cylinder, thereby causing a friction loss and abrasion between them. Hence, it is important to block the introduction of the foreign materials into the fluid bearing, in terms of enhancing reliability of the compressor.

Figure 5:
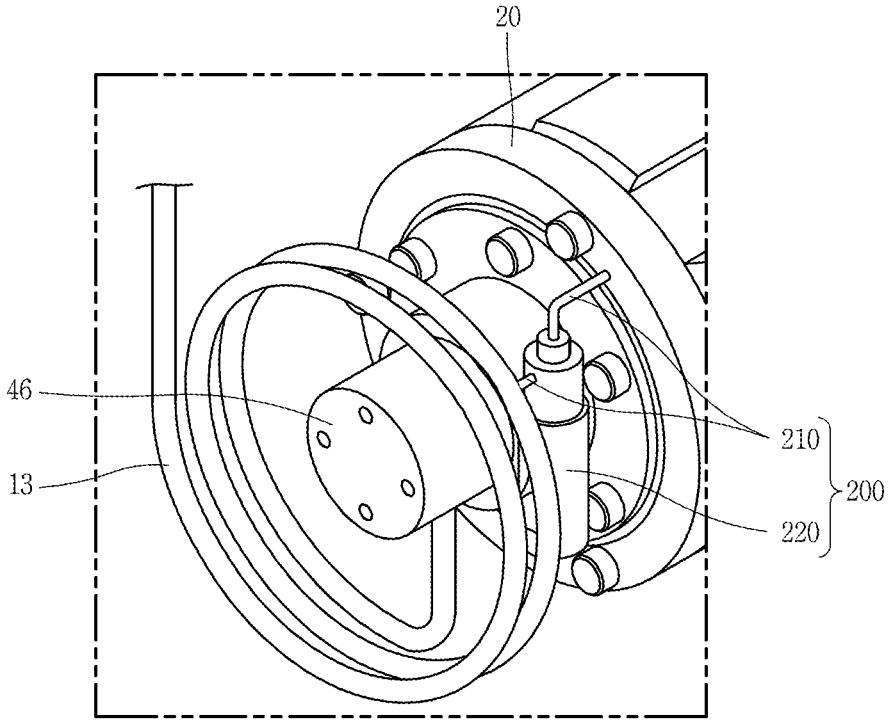
FIG. 5 is a perspective view illustrating a gas guiding unit of the fluid bearing according to FIG. 3.
Figure 6:
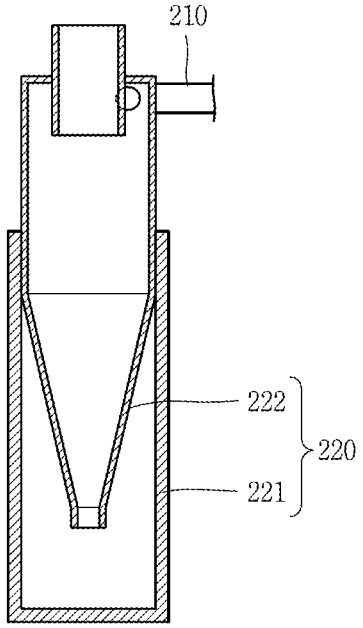
FIG. 6 is a sectional view illustrating one example of a filtering unit of FIG. 5.

FIG. 5 is a perspective view illustrating a gas guiding unit of a fluid bearing according to FIG. 3, FIG. 6 is a sectional view illustrating one example of a filtering unit of FIG. 5, and FIGS. 7 to 10 are sectional views illustrating other embodiments of a gas guiding unit of the fluid bearing according to FIG. 3.

As illustrated in FIG. 5, a filtering unit may be provided at a middle portion of a gas guiding pipe. That is, a gas guiding pipe 210 may branch out at a middle portion of the discharge pipe 13 and be connected to an inlet of the gas pocket 110. A filtering unit 220 configuring a block-preventing unit may be connected to a middle portion of the gas guiding pipe 210 so as to filter off foreign substances from a refrigerant which flows into the gas pocket 110.

The gas guiding pipe 210 may preferably be formed as long as possible, such that refrigerant gas introduced into the gas pocket 110 through the gas guiding pipe 210 can be cooled and decompressed by performing heat exchange with a low-temperature sucked refrigerant, which is filled in the inner space 11 of the casing 10. To this end, the gas guiding plate 210 may preferably be wound several times to cover surroundings of the discharge cover 46 with being spaced apart from an outer circumferential surface of the discharge cover 46. Alternatively, the gas guiding pipe 210 may also be connected directly to the discharge space S2 of the discharge cover 46, which is coupled to the end surface of the cylinder 41.

The filtering unit 220, as illustrated in FIG. 5, may include a filter housing 221 connected to a middle portion of the gas guiding pipe 210, and a filter 222 located in the filter housing 221 to filter off foreign materials.

The filter housing 221 is a filtering space in which the foreign materials are filtered off. An inlet of the filtering space may communicate with the discharge space S2 through the gas guiding pipe 210 while an outlet of the filtering space may be connected to the gas pocket 110 through the gas guiding pipe 210. A cross-section of the filtering space may be greater than a cross-section of the gas guiding pipe 210.

The filter 222, as illustrated in FIG. 6, may be configured as a cyclone filter for filtering and collecting foreign materials, such as metal pieces, using a cyclone effect, or as a mesh filter using a filtering effect. When a filtering space is not separately required, the filter 222 such as the mesh filter may be located at the outside (for example, at the inlet of the gas pocket 110) of the filter housing 221.

Figure 7:
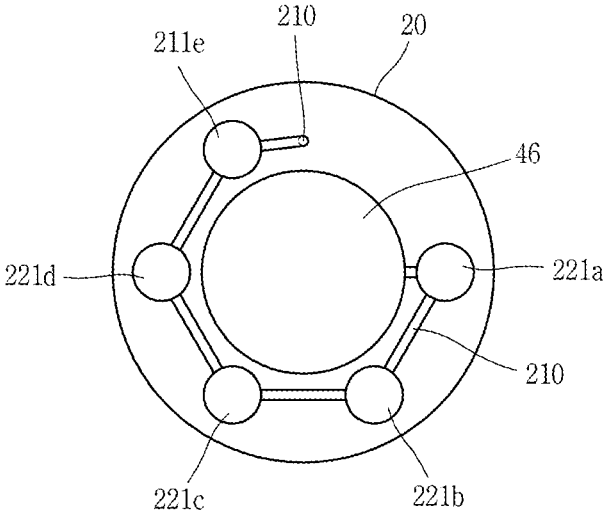
FIGS. 7 to 10 are sectional views illustrating other embodiments of a gas guiding unit of the fluid bearing according to FIG. 3.

The filter housing 221 may be provided in singular, but, as illustrated in FIG. 7, a plurality of filter housings 221*a* to 221*e* may be serially connected by a single gas guide pipe 210. When the filter housing is provided in plural, it may be preferable to install a filter (not illustrated) in only one of the plurality of filter housings, in terms of reducing installation costs and preventing pressure of compressed gas from being excessively lowered due to flow resistance.

Figure 8:
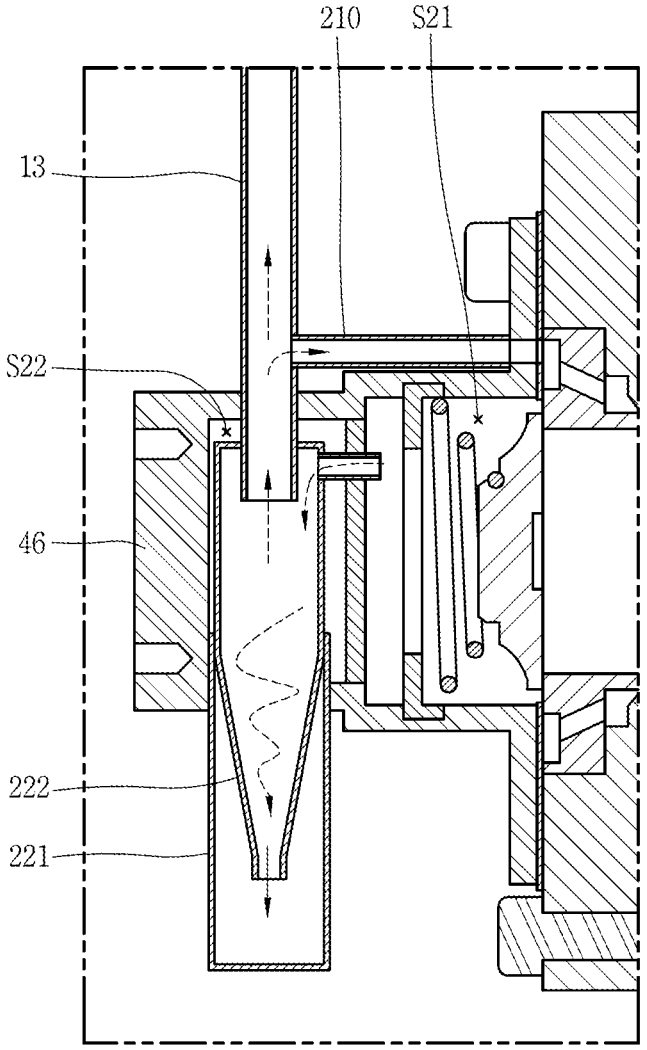

The filter housing 221 may also be installed in the discharge cover 46, as illustrated in FIG. 8. In this instance, the discharge cover 46 may be divided into a first discharge space S21 having the discharge valve 44 installed therein, and a second discharge space S22 having the filter 222 installed therein. The first discharge space S21 and the second discharge space S22 may communicate with each other. The discharge pipe 13 and the gas guiding pipe 210 may branch out at an outlet of the filter housing 221.

Figure 9:
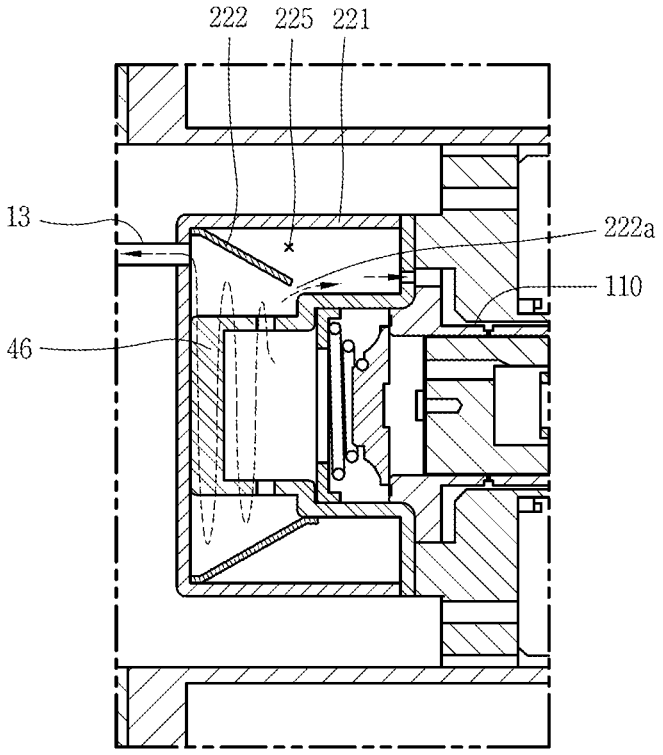

Also, the filter housing 221 may be installed to cover an outside of the discharge cover 46, as illustrated in FIG. 9. In this instance, the discharge space S2 of the discharge cover 46 may communicate with the filtering space 225 of the filter housing 221, and the discharge pipe 13 may be connected to the filter housing 221.

Here, a truncated conical filter 222 may be provided on an inner circumferential surface of the filter housing 221 so as to configure a cyclone filter. A gas through hole 222*a* may be formed at one side of the filter 222 to communicate with the gas guiding pipe 210.

In this instance, the filtering space 225 of the filter housing 221 may be coupled to accommodate therein the inlet of the gas pocket 110.

Figure 10:
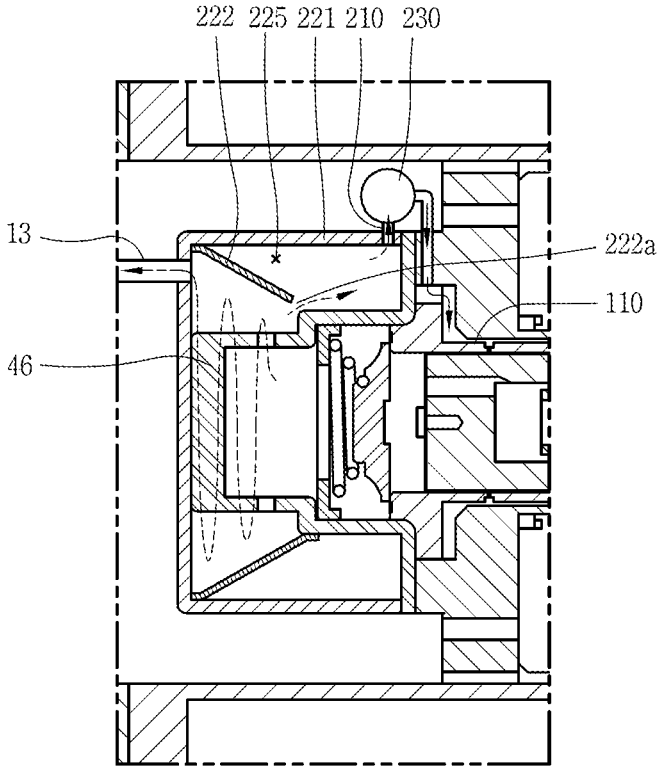

Meanwhile, as illustrated in FIG. 10, the inlet of the gas pocket 110 may be located at the outside of the filter housing 221, the filter housing 221 and the gas pocket 110 may be connected to each other through the gas guiding pipe 210, and a muffler 230 may be provided at a middle portion of the gas guiding pipe 210. Here, pulsation noise and vibration which are generated when compressed gas is discharged can be more offset because they are offset through the muffler 230 once more. In this instance, a mesh filter may further be provided at an outlet side of the muffler 230.

In the reciprocating compressor according to the embodiment disclosed herein, when the filtering unit 220 is installed at a discharge side of the compression space S1, a part of compressed refrigerant gas may be introduced into the filter housing 221 through the gas guiding pipe 210 or directly introduced into the filter housing 221 through the discharge space S2, thereby passing through the filter 222 located in the filtering housing 221. Accordingly, foreign materials mixed with the refrigerant gas may be filtered off by the filter 222, thereby preventing in advance the introduction of the foreign materials into the fluid bearing 100.

In such a manner, the gas holes which are configured as fine holes can be prevented from being blocked due to the foreign materials, such that the fluid bearing can stably support a portion between the cylinder and the piston while the compressor smoothly operates.

In addition, the filter housing can serve as a type of a muffler and simultaneously reduce pressure pulsation of a discharged refrigerant, thereby reducing discharge noise of the compressor.

Also, as the gas guiding pipe is installed at the outside of the discharge cover and simultaneously formed long in length, the compressed gas introduced into the gas pocket of the fluid bearing can be cooled by a low-temperature sucked refrigerant filled in the inner space of the casing, which may allow for cooling the cylinder defining the gas pocket and thus reducing a specific volume of the compression space, thereby enhancing compressor efficiency.

In the meantime, description will be given of another embodiment of a filtering unit of the reciprocating compressor according to the present invention.

That is, the foregoing embodiments illustrate that the filtering unit is located at the discharge side of the compression space, but these embodiments illustrate that the filtering unit is provided at an inlet side of the compression space.

Figure 11:
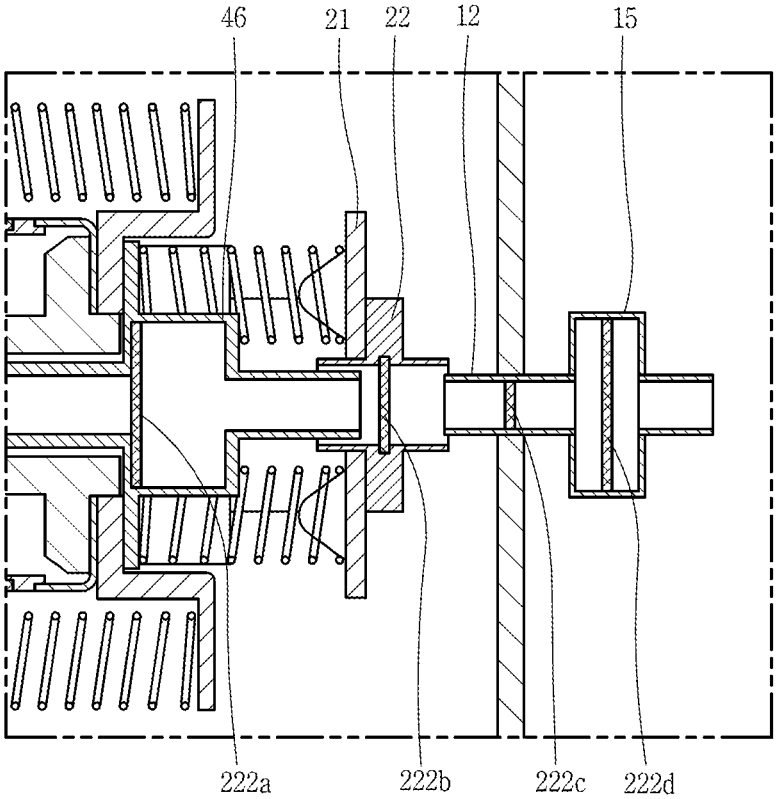
FIG. 11 is a sectional view illustrating another embodiment of a filtering unit of the fluid bearing according to FIG. 3.

To this end, as illustrated in FIG. 11, filters 222*a* to 222*d* may be provided in a suction muffler 47 which is coupled to an inlet of the suction passage F of the piston 42, in an intermediate pipe 22 coupled to a back cover 21, in a suction pipe 12 coupled to the casing 10, or in a suction muffler 15 coupled to the casing 10.

Even in this instance, as aforementioned, those filters may be implemented as a mesh filter or a cyclone filter. Even when the filtering unit is provided at the suction side of the compression space as illustrated in these embodiments, the operation effect may be the same as or similar to those of the foregoing embodiments. However, in these embodiments, as the filtering unit is provided at the suction side of the compression space, foreign materials may be filtered off from a refrigerant before the refrigerant is sucked into the compression space and accordingly the cylinder and the piston may be prevented in advance from being abraded due to foreign materials within the compression space.

The foregoing embodiments illustrate that the cylinder is inserted into the stator of the reciprocating motor. However, those positions of the gas holes may be equally applied even when the reciprocating motor is mechanically coupled with a predetermined interval to a compression unit including the cylinder. Detailed description thereof will be omitted.

Also, the foregoing embodiments illustrate that the piston is configured to perform a reciprocating motion and thus the resonant springs are provided at both sides of the piston in the motion direction of the piston. However, in some cases, the cylinder may also be configured to perform a reciprocating motion and thus the resonant springs may be installed at both sides of the cylinder. Even in this instance, the positions of the gas holes may be equal to those in the foregoing embodiments, of which detailed description will be omitted.

In the meantime, the foregoing embodiments illustrate that the filtering unit is provided on a passage of refrigerant gas to filter off foreign materials before the refrigerant gas is introduced into the gas holes. However, these embodiments illustrate that the cylinder is periodically shaken to remove foreign materials stuck in the gas holes of the cylinder when the compressor continuously operates for a predetermined period of time, thereby preventing the blocking of the gas holes in advance.

Figure 12:
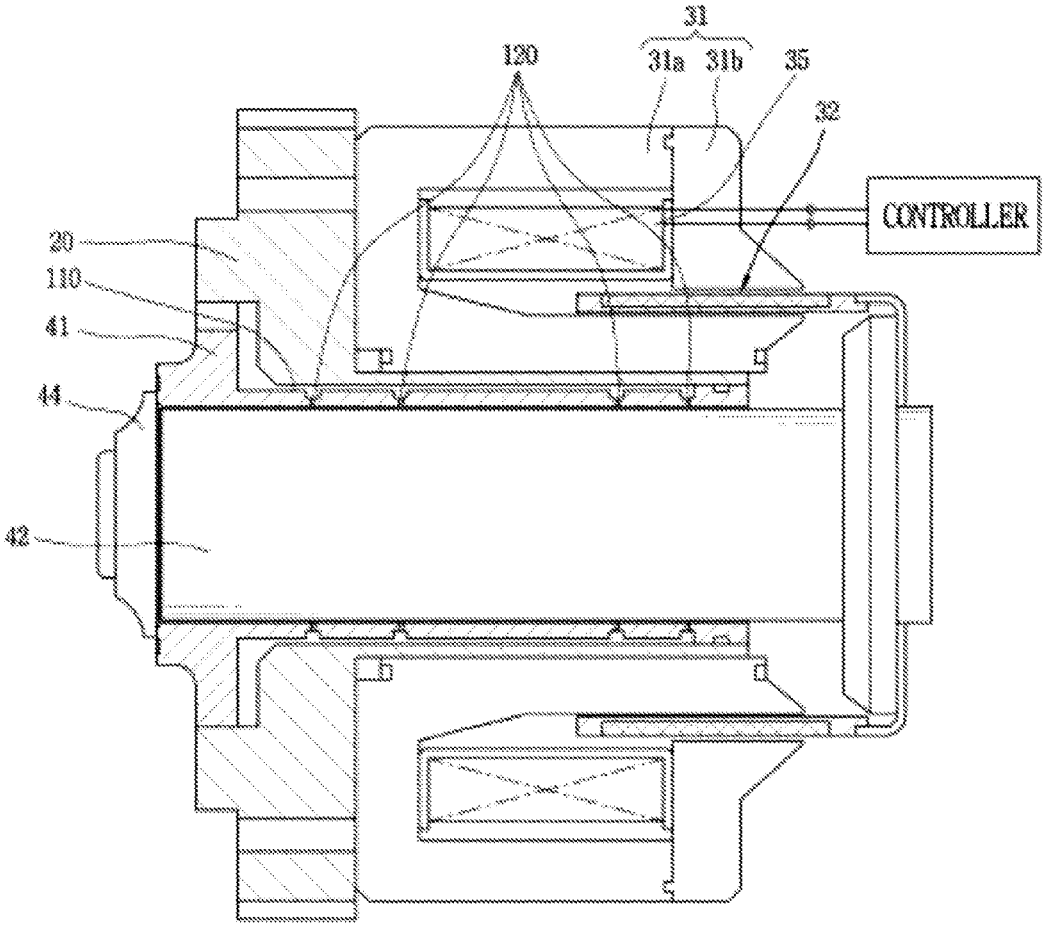
FIG. 12 is a longitudinal sectional view illustrating a main portion for another embodiment of a fluid bearing of a reciprocating compressor in accordance with the present invention.
Figure 13:
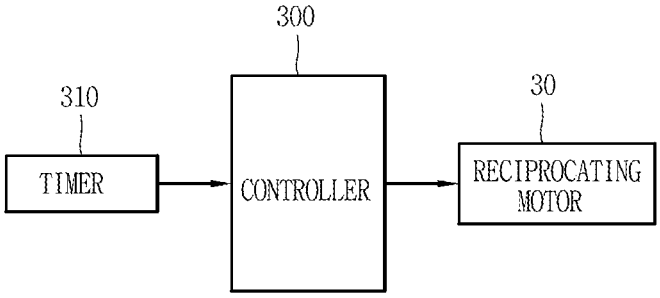
FIG. 13 is a schematic view illustrating a structure of a controller of the compressor to remove foreign materials according to FIG. 12.
Figure 14:
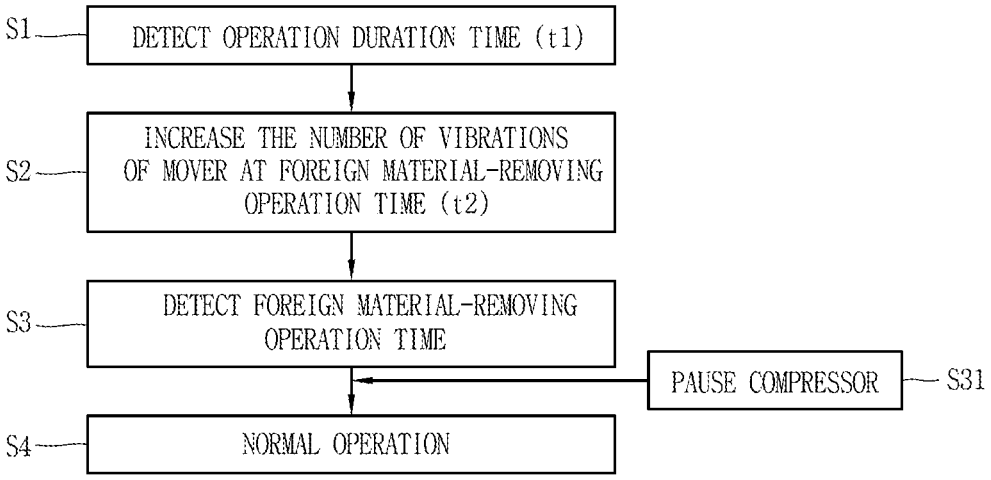
FIG. 14 is a block diagram illustrating a foreign material removing process according to FIG. 13.

FIG. 12 is a longitudinal sectional view illustrating a main portion for another embodiment of a fluid bearing of a reciprocating compressor in accordance with the present invention, FIG. 13 is a schematic view illustrating a structure of a controller of the compressor to remove foreign materials according to FIG. 12, and FIG. 14 is a block diagram illustrating a foreign material-removing process according to FIG. 13.

For example, as illustrated in FIGS. 12 to 14, an operation duration time t1 of the compressor is detected using a timer 310 which is provided at a controller 300 of the compressor (S1).

When the detected operation duration time t1 reaches a preset foreign material-removing operation time (t2), the controller 300 increases the number of vibrations of the mover 32 (namely, the number of vibrations of the piston), which typically vibrates at 30 to 120 Hz, for example, up to 1 kHz or more (S2). Accordingly, the piston 42 coupled to the mover 32 performs a fast reciprocating motion. While the piston 42 fast reciprocates, a resonant frequency of the resonant springs 51 and 52 increases as high as the change in the number of vibrations of the piston 42, thereby exciting the stator 31. In response to the excitation of the stator 31, the cylinder 41 is excited by the frame 20 coupled to the stator 31 so as to generate a type of "shaking effect (or vibration effect)," thereby removing foreign materials stuck in the gas holes 120.

Here, when a supporting spring 15 is provided on a bottom surface of the casing 10 to elastically support an installation surface of the compressor, the casing 10 may greatly be excited in response to the change in the vibration of the piston 42, and accordingly the effect of shaking the cylinder 41 may be more increased.

Afterwards, when a predetermined time elapses after the foreign material-removing operation t2 has started, the controller 300 controls the number of vibrations of the mover 32 (namely, the number of vibrations of the piston 41) to be decreased down to the number of vibrations at a typical operation, such that the compressor executes a normal operation (S3 and S4).

Here, the compressor may also be controlled to return to its normal operation state immediately after executing the operation of shaking the foreign materials out, but a process of pausing (or stopping) the mover 32 (namely, the piston 41) for a predetermined time is further executed (S31) in some cases. Through the process, the foreign materials may be removed from the gas holes 120 while the compressor is paused, thereby increasing the effect of removing the foreign materials.

In such a manner, even though some of the gas holes are blocked due to foreign materials introduced into the fluid bearing along with the compressed refrigerant gas, the cylinder may periodically be vibrated to remove the foreign materials stuck in the gas holes. This may result in preventing the gas holes as the fine holes from being blocked due to the foreign materials so as to allow for a smooth operation of the fluid bearing and a stable support of a portion between the cylinder and the piston.

In the meantime, the foregoing embodiments illustrate that the cylinder is inserted into the stator of the reciprocating motor, but those positions of the gas holes may equally be applied even when the reciprocating motor is mechanically coupled with a predetermined interval to a compression unit including the cylinder. Detailed description thereof will be omitted.

Also, the foregoing embodiments illustrate that the piston is configured to perform a reciprocating motion and thus the resonant springs are provided at both sides of the piston in the motion direction. However, in some cases, the cylinder may be configured to perform a reciprocating motion and thus the resonant springs may be installed at both sides of the cylinder. Even in this instance, the positions of the gas holes may be equal to those in the foregoing embodiments. Detailed description thereof will be omitted.

The invention claimed is:

1. A reciprocating compressor comprising:

a casing having an inner space communicating with a suction pipe;

a frame provided in the inner space of the casing;

a reciprocating motor coupled to the frame, and having a mover, the mover performing a linear reciprocating motion;

a cylinder coupled to the frame and having a compression space;

a piston inserted into the cylinder to perform a reciprocating motion, the piston having a suction passage formed there through in a lengthwise direction to guide a refrigerant into the compression space;

a suction valve coupled to an end surface of the piston and configured to open and close the suction passage;

a discharge valve provided at an end surface of the cylinder and configured to open and close the compression space;

a discharge cover installed at an end side of the cylinder and having a discharge space accommodating the discharge valve therein, the discharge space communicating with a discharge pipe;

a gas bearing having a plurality of gas holes penetratingly formed in the cylinder, the plurality of gas holes configured to inject therethrough a part of the refrigerant, discharged from the compression space into the discharge space, into a portion between the cylinder and the piston so as to support the piston with respect to the cylinder; and a block-preventing unit configured to prevent the gas holes of the gas bearing from being blocked due to foreign materials, wherein the block-preventing unit is configured as a vibration unit to vibrate the cylinder, the vibration unit including a controller to excite a number of vibrations of the reciprocating motor to a frequency higher than an operating frequency and a timer configured to vibrate the cylinder at predetermined periods, and wherein the block-preventing unit determines whether or not a foreign material-removing operation is required, and the controller increases a number of vibrations of the piston when the foreign material-removing operation is required to shake out foreign materials from the gas holes of the cylinder, and after the foreign material-removing operation is complete, decreases the number of vibrations of the piston to return to a normal operation.

2. The compressor of claim 1, wherein the vibration unit includes at least one spring configured to transfer vibration of the piston to the cylinder.

3. The compressor of claim 2, wherein the at least one spring is configured as a compression coil spring, and wherein the spring has one end supported by the frame and the other end supported by the mover so as to have elasticity in a motion direction of the mover.

4. The compressor of claim 2, wherein the cylinder is coupled to the frame, and the frame is coupled to a stator of the reciprocating motor in which the mover performs a reciprocating motion, wherein the mover is coupled to the piston, and wherein both ends of the at least one spring are coupled between the mover and the stator.

5. The compressor of claim 4, wherein the frame is fixed to the casing, and wherein supporting members are coupled to an outer circumferential surface of the casing to elastically support an installation surface.

6. The compressor of claim 1, wherein the vibration unit includes at least one spring configured to transfer vibration of the piston to the cylinder, wherein the cylinder is coupled to the frame, and the frame is coupled to a stator of the reciprocating motor in which the mover performs a reciprocating motion, wherein the mover is coupled to the piston, and wherein both ends of the spring are coupled between the mover and the stator.

7. The compressor of claim 6, wherein supporting members are coupled to an outer circumferential surface of the casing to elastically support an installation surface.

8. A method for driving a reciprocating compressor having a reciprocating motor, a cylinder, a piston, a gas bearing, and a block-preventing unit provided with a vibration unit having a timer configured to vibrate the cylinder at predetermined periods, and a controller to excite a number of vibrations of the reciprocating motor to a frequency higher than an operating frequency, the method comprising:

determining whether or not a foreign material-removing operation is required;

shaking out foreign materials from gas holes formed in the cylinder by increasing a number of vibrations of the piston when the foreign material-removing operation is required; and, after the foreign material-removing operation is complete, executing a normal operation by decreasing the number of vibrations of the piston.

9. The method of claim 8, further comprising removing the foreign materials from the gas holes by pausing the piston for a predetermined period of time after an operation of shaking the foreign materials out.

10. The method of claim 9, wherein the determining as to whether or not the foreign material-removing operation is required is performed by detecting an operation time of the compressor.

* * * * *